United States Patent [19]

Lindqvist

[11] 4,339,081

[45] Jul. 13, 1982

[54] LIQUID FLOW CHANNEL

[75] Inventor: Lars A. Lindqvist, Sigtuna, Sweden

[73] Assignee: Spar Vatten Och Energi AB, Sigtuna, Sweden

[21] Appl. No.: 187,840

[22] PCT Filed: Mar. 1, 1979

[86] PCT No.: PCT/SE79/00045

§ 371 Date: Nov. 2, 1979

§ 102(e) Date: Nov. 2, 1979

[87] PCT Pub. No.: WO79/00690

PCT Pub. Date: Sep. 20, 1979

[30] Foreign Application Priority Data

Mar. 2, 1978 [SE] Sweden ..... 7802369

[51] Int. Cl.[3] ..... B05B 1/18

[52] U.S. Cl. ..... 239/552; 239/589; 239/599; 239/601

[58] Field of Search ..... 239/460, 568, 589, 592–597, 239/599, 601, 552

[56] References Cited

U.S. PATENT DOCUMENTS

| | | | |
|---|---|---|---|
| 1,192,901 | 8/1916 | Irish | 239/589 |
| 2,125,445 | 8/1938 | Holveck | 239/599 |
| 2,285,831 | 6/1942 | Pennypacker | 239/460 |
| 3,563,469 | 2/1971 | Stacey | 239/460 X |
| 3,647,145 | 3/1972 | Nelson | 239/460 |
| 4,097,000 | 6/1978 | Derr | 239/599 |

*Primary Examiner*—Johnny D. Cherry

*Attorney, Agent, or Firm*—Cushman, Darby & Cushman

[57] ABSTRACT

A flow channel for a liquid, preferably water, one of several such channels (10;10') being intended to be arranged, for example, in a shower nozzle, a mixer-cock nozzle or the like, and the channel (10;10') having an oblong cross-section. The channel has a length, which substantially exceeds its width, and the channel (10;10') widens in the width and height direction in the area of its inlet and outlet end.

7 Claims, 6 Drawing Figures

LIQUID FLOW CHANNEL

RELATED APPLICATION

This is a PCT national application based on copending International Application PCT/SE79/00045.

This invention relates to a flow channel for a liquid, preferably water, one or several of which channels are intended to be arranged, for example, in a shower nozzle, a mixing-cock nozzle or the like, and which channel has an oblong cross-section.

At the shower nozzles at present in use the flow channels are circular or rectangular holes. Every nozzle usually comprises a very great number of holes to prevent the individual jets from being too sharp. The result, however, is an unnecessarily high water consumption when taking a shower.

The present invention has the object to provide a flow channel, which has a high flow resistance and also implies, that the liquid after the passage is atomized. This object is achieved by means of a flow channel, which has been given the characterizing features defined in the claims.

Owing to the high flow resistance, the water consumption is decreased, but a good shower comfort is maintained by the atomization, and the jets are not perceived as sharp.

The water amount permitted to pass by the channels according to the invention is experienced as fully satisfactory when taking a shower.

Figure 1:
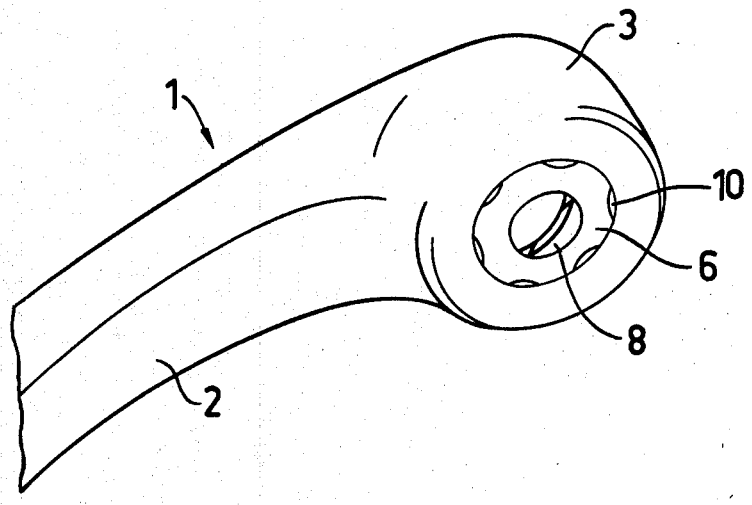
Figure 2:
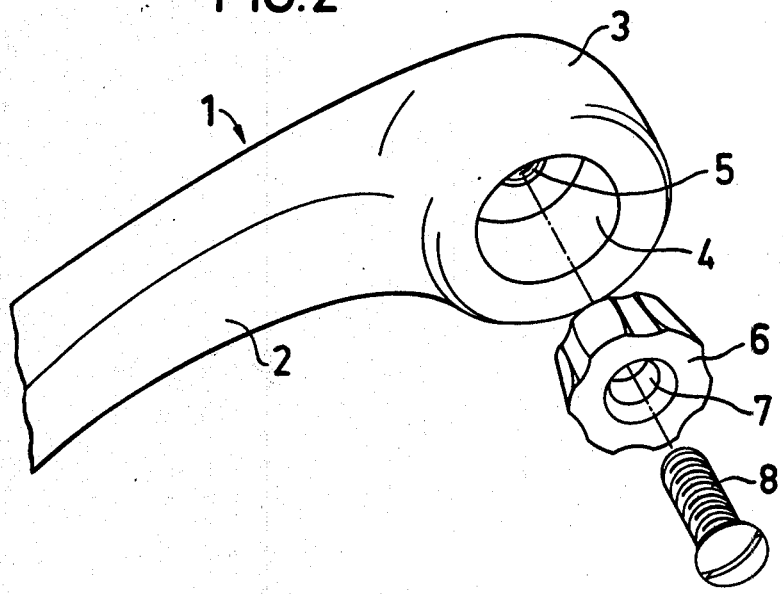
Figure 3:
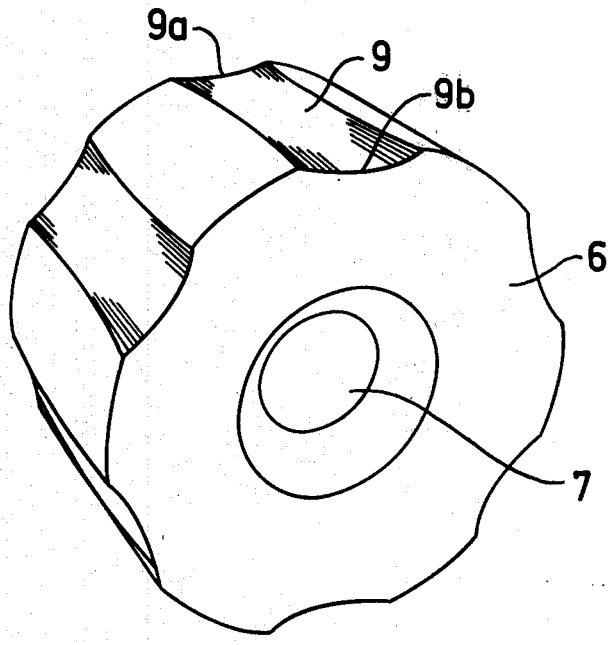
Figure 4:
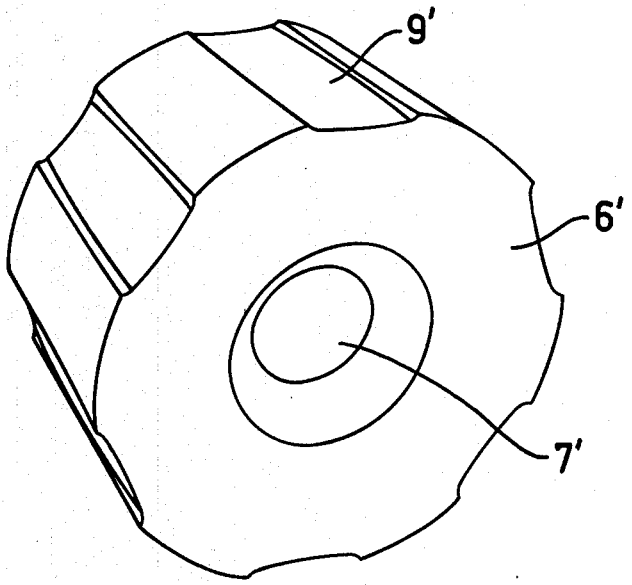
Figure 5:
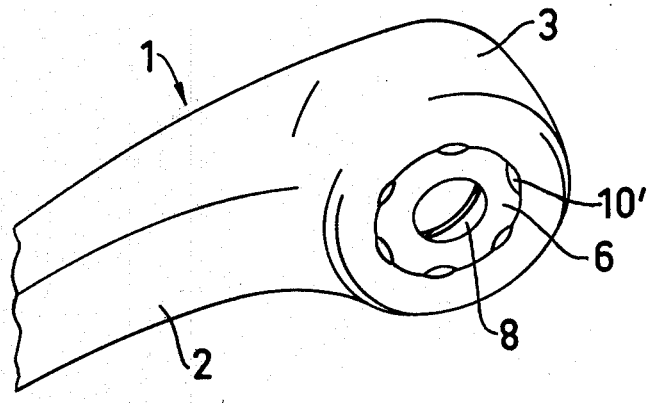
Figure 6:
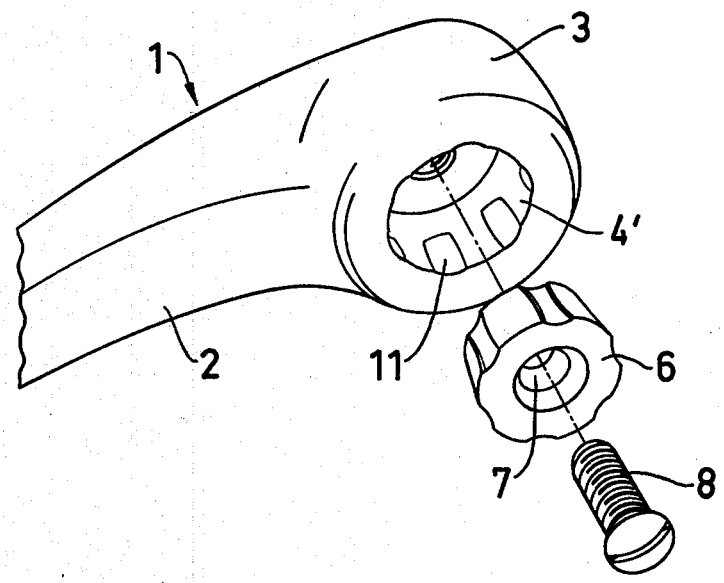

An embodiment of the invention is described below with reference to the accompanying drawings, in which FIG. 1 shows a shower handle with flow channels according to the invention, FIG. 2 is an exploded view of the shower handle shown in FIG. 1, FIG. 3 shows a sprayer insert with grooves, which form a part of the channels, FIG. 4 shows another embodiment of a sprayer insert, FIG. 5 shows a shower handle with another embodiment of the seat, and FIG. 6 shows an exploded view of the shower handle shown in FIG. 5.

The shower handle 1 in FIGS. 1 and 2 comprises a holder portion 2, which transforms to a head portion 3, in which a seat 4 is formed. In the bottom of the seat 4 a countersunk thread 5 is located in the centre of the seat.

As appears from FIGS. 1 and 2, a sprayer insert 6 with the basic shape of a truncated cone is intended to be mounted in the seat 4. The circular wall of the seat 4 has an inclination corresponding to the conicity of the insert 6.

The insert has a central through hole 7, in which a threaded screw 8 can be received. The hole 7 is countersunk at its end facing toward the head of the screw 8.

The screw 8, as shown in FIG. 2, is intended to be engaged with the thread in the bottom of the seat 4.

The insert 6 having been positioned, and the screw 8 been screwed into the thread 5, the shower handle 1 has the appearance shown in FIG. 1.

As can be seen in FIG. 2, the insert 6 has a shorter extension in the longitudinal direction of the screw 8 than the seat 4. The conicity of the insert 6 and the inclination of the seat walls are so adjusted to each other, that the outer end of the insert 6 in mounted state is on the same level as the outwardly facing end of the head portion. This implies, that a chamber is formed between the inwardly facing end of the insert 6 and the bottom of the seat 4.

Into said chamber opens a supply channel for water extending through the holder portion 2, so that the water is collected to the chamber before flowing out past the insert 6.

As is apparent already from FIGS. 1 and 2, but most clearly is shown in FIG. 3, the insert 6 is formed with grooves 9 extending substantially in the longitudinal direction of the screw 8. At the embodiment shown in FIGS. 1–3 six grooves 9 are provided. The grooves 9, as shown in FIG. 1, together with the walls of the seat 4 form flow channels for water.

FIG. 3 shows that the grooves 9 have a great width in relation to their depth. The bottom of the grooves 9, besides, is not plane at the embodiment shown, but slightly rounded. In the area of their inlet and, respectively, outlet the grooves 9 have a greater width and also a greater depth, because it has been found by empiric experiments that a widening and deepening of the grooves 9 at their end areas favorably affect the behaviour of the water flowing through.

In FIG. 4 a sprayer insert 6′ is shown, at which the grooves 9′ have a bottom of greater planeness than the grooves 9 in FIG. 3. Besides, the grooves 9′ in FIG. 4 have a width which increases continuously from the inlet end to the outlet end. Like the grooves 9 in FIG. 3, the grooves 9′ in FIG. 4 have a depth increasing at their end areas.

At experiments it was found that the following factors are of importance for designing the grooves 9, 9′.

The flow channels formed by the grooves 9, 9′ and the seat 4 shall have a substantially flat cross-section, i.e. the width of the channels shall exceed their height substantially.

As already mentioned above in the introductory portion, one of the objects of the present invention is to atomize the water flowing out, i.e. the jets shall form a spray. It was found that a flat cross-section has a very favourable effect on said spray formation. The jet, after having been caused to assume a flat cross-section, tends at the earliest possible occasion to contract again to a circular cross-section. One of the reasons of this is the surface tension of the water.

The water at the edges of the flat jet thereby flows inward to the centre of the jet. This gives rise to the tendency of too much water collecting in the centre of the jet, so that the jet again spreads, now in a direction which is perpendicular to the first spread direction. This changing of the spread directions of the jet can continue a number of times, for which, however, the velocity of the jet is of importance.

At the experiments carried out in connection with the development of the present invention, the jet having passed through an individual channel and entering the free air has spread in a direction, which is radial with respect to the centre of the cone-shaped insert 6. The flat jet in the flow channel, however, then apparently has such a high velocity that, when the contraction takes place and the spread direction changes, the pressure in the jet is so high that the jet is atomized, forms a spray, in the new direction of spread. This is highly favourable at a shower where, thus, the jets form a spray in radial direction with respect to the centre of the insert 6. The centre of the water cone thereby is filled with water, so that the water upon its contact with the body is distributed over a greater surface and thereby promotes the feeling of comfort.

As appears from FIG. 3, the grooves 9 have been widened and deepened at their inlet opening 9*a*.

For the flow of a liquid through a hole or a channel, the form of the inlet opening is of great importance. When the inlet opening has sharp edges, the liquid passing therethrough contracts to a jet, which does not fill the cross-section of the channel (contraction). In order to reduce this effect, the edges of the inlet opening can be rounded as indicated in FIG. 3. The jet hereby fills better the channel cross-section (Coanda effect), and the flow runs more smoothly. Besides, a better filling of the channel cross-section implies an increase of the jet width relative to its height, which also favourably affects the atomization.

At the embodiment shown in FIG. 3, the grooves 9 are widened and deepened also at their outlet ends 9*b*, because it was found at experiments, that just this feature is extremely important for the jet to assume spray form to the desired extent at a reasonable liquid pressure.

The insert 6 shown in the drawings when being mounted in the seat 4, as is most clearly apparent from FIG. 1, gives rise to the formation of flow channels 10 with a cross-section tapering toward their edges. Owing to the high width-height ratio of the channels 10, the flow resistance for the liquid flowing therethrough, preferably water, is high. The water consumption, as already pointed out, thereby is very low, but due to the atomization a good shower comfort is maintained.

The insert 6' shown in FIG. 4 includes grooves 9', which like the grooves 9 widen toward the outlet end, but do not widen toward the inlet end. Besides, the grooves 9' have a bottom which is more plane than the bottom of the grooves 9. The insert 6', conclusively, can be said to bring about a slightly reduced atomization of the jets compared with the insert 6. The jets are more concentrated and, therefore, are perceived as sharper jets. Certain persons, however, prefer sharper jets as they have a stronger massaging effect.

At the embodiment shown in FIGS. 5 and 6, also the seat 4' is provided with grooves 11, which however have an extension in the longitudinal direction to only about half the height of the seat 4'.

Due to the grooves 11, the flow channels 10' have a still greater widening in height direction compared with the embodiments described above. It was found that this widening in height direction still more improves the spray formation of the jet.

The reason why the grooves 11 extend only to half the height of the seat 4' is, that the cross-section of the channel 10' immediately inside of the beginning of the groove 11 is dimensioned for the amount of water which per time unit can pass through the channel. When this cross-section is not maintained, then there is risk that the channel looses its water-saving property.

The seat 4' shown in FIGS. 5 and 6 is intended for use primarily together with the cone 6, as appears from said Figures.

It applies to all embodiments shown that it is of advantage to provide some kind of pressure control in the water conduit, through which the water flows before it arrives at the flow channel.

The design of the grooves in the nozzle, thus, varies depending on how sharp or soft the jets are desired to be.

The flow channel has been described above in connection with a shower handle, but its application of course is not restricted thereto. A flow channel according to the invention is well suitable for use at mixer-cocks for kitchen sinks. Another imaginable field of application are dish washers.

The invention, thus, can be varied freely within the scope of the attached claims.

I claim:

1. A shower nozzle having a plurality of side-by-side flow channels for liquid, each flow channel having an inlet end and an outlet end and having a length substantially exceeding its width, the transverse cross-section of the flow channel being oblong along essentially its whole length and having a greater width and height in the area of the inlet and outlet ends than in the intermediate area between said ends.

2. A shower nozzle as in claim 1 wherein in transverse cross-section the walls of each channel are curved and the cross-sectional area of the channel, from its center, continuously decreases in the width direction to zero.

3. A shower nozzle as in claim 1 wherein each flow channel is symmetric with respect to a plane extending in the center of the channel perpendicularly to the width direction of the transverse cross-section.

4. A shower nozzle as defined in claim 1 or claim 2 wherein the flow channels are arranged such that their transverse cross-sections lie in an arc.

5. A shower nozzle as in claim 4 having a body formed with a conical seat therein and a conical insert engaging the seat, the conical surface of the insert having a plurality of shallow grooves which, with the surface of the seat, form said flow channels.

6. A shower nozzle as in claim 5 wherein the depth of said groove increases toward each end of the conical insert.

7. A shower nozzle as in claim 5 wherein the surface of the conical seat has grooves extending longitudinally from the larger end to about half way to the smaller end of the seat, each groove being disposed opposite one of the grooves in said insert.

* * * * *